United States Patent [19]

Konecny et al.

[11] Patent Number: 4,740,016

[45] Date of Patent: Apr. 26, 1988

[54] LOTTERY TICKET

[75] Inventors: George Konecny, Richmond Hill; Gordon Paget, Niagara-on-the-Lake, both of Canada

[73] Assignee: Bingo Press & Specialty Ltd., King City, Canada

[21] Appl. No.: 879,774

[22] Filed: Jun. 27, 1986

[51] Int. Cl.[4] ..... B42D 15/00; A63B 71/00

[52] U.S. Cl. ..... 283/903; 273/139

[58] Field of Search ..... 283/72, 99, 100, 903; 346/76 PH; 273/139 R

[56] References Cited

U.S. PATENT DOCUMENTS

| | | | |
|---|---|---|---|
| 4,099,721 | 7/1978 | Ingemar | 283/903 |
| 4,174,857 | 11/1979 | Koza | 283/903 |
| 4,591,190 | 5/1986 | Clark | 283/903 |

FOREIGN PATENT DOCUMENTS

| | | | |
|---|---|---|---|
| 2075918 | 12/1979 | United Kingdom | 283/903 |
| 2085308 | 4/1982 | United Kingdom | 283/903 |
| 2082119 | 3/1983 | United Kingdom | 283/903 |

*Primary Examiner*—E. R. Kazenske
*Assistant Examiner*—Paul M. Heyrana, Sr.
*Attorney, Agent, or Firm*—Rogers, Bereskin & Parr

[57] ABSTRACT

A lottery ticket has a front sheet, a rear sheet and an adhesive layer for bonding the front sheet and the rear sheet together. The side of the rear sheet which faces the front sheet bears a plurality of symbols. This plurality of symbols includes a set of winning symbols. The lottery ticket also comprises security indicia on the same side of the rear sheet. These security indicia include a pattern, a winning ticket code, and a winning prize code. These security indicia may be used either singularly or in combination.

17 Claims, 1 Drawing Sheet

LOTTERY TICKET

FIELD OF THE INVENTION

This invention relates generally to the field of lottery tickets and, more particularly, it relates to a lottery ticket which has a number of windows which can be removed to reveal a set of symbols.

BACKGROUND OF THE INVENTION

It is known to make lottery tickets which contain a plurality of windows. One way of manufacturing such tickets is by pattern gluing. This method employs the use of two sheets of paper. On one sheet, namely the rear sheet, a plurality of symbols are printed. The other sheet, namely the front sheet, has a plurality of perforated die cut closure panels which define a plurality of windows. The panels are placed so that when the front and rear sheets are glued together and the panels are opened along their perforated edges, the symbols are revealed. The glue is applied to the sheets in a pattern so that when the tickets are assembled, the windows are not bonded to the rear sheet.

One of the problems with such a ticket is that a losing ticket may be relatively easily and fraudulently changed into a winning ticket. This is done by removing the winning symbols from a previously honoured winning ticket and inserting them in a losing ticket. The paper which contains the winning symbols is removed from the winning ticket by making cuts along the four edges of the window down to a middle level of the paper. Similarly, a losing set of symbols is removed from a losing ticket. Once the winning symbols have been placed in the losing ticket, it is difficult to detect the alteration.

BRIEF SUMMARY OF THE INVENTION

The present invention provides a lottery ticket comprising a front sheet, a rear sheet, means bonding said front sheet and said rear sheet together, a plurality of symbols on one side of said rear sheet facing said front sheet, said symbols including a set of winning symbols, and security indicia on the said one side of said rear sheet corresponding to said set of winning symbols.

A lottery ticket comprising a rectangular front sheet which defines five windows and includes four bars separating said windows from one another, said windows being located in a stacked formation, a rectangular rear sheet, means bonding said front and rear sheets together, a plurality of symbols on one side of said rear sheet facing said front sheet, said symbols being arranged into sets of symbols including a set of winning symbols with each set of symbols located within a respective window and said set of winning symbols being located in a winning window, wherein said one side of said rear sheet contains security indicia corresponding to said set of winning symbols.

The security indicia refers to a pattern which is contained on the portion of the rear sheet which contains the winning symbols, said pattern extending beyond the winning window and being partially covered by portions of said front sheet around said winning window.

The security indicia also refers to a winning prize code which is not located in said winning window.

The security indicia also refers to a winning ticket code which is contained in said winning window. These security indicia may be used either separately or in combination.

BRIEF DESCRIPTION OF THE DRAWINGS

The invention will be better understood with reference to the accompanying drawings which show a preferred embodiment of the present invention and in which.

DESCRIPTION OF THE PREFERRED EMBODIMENT

Figure 2:
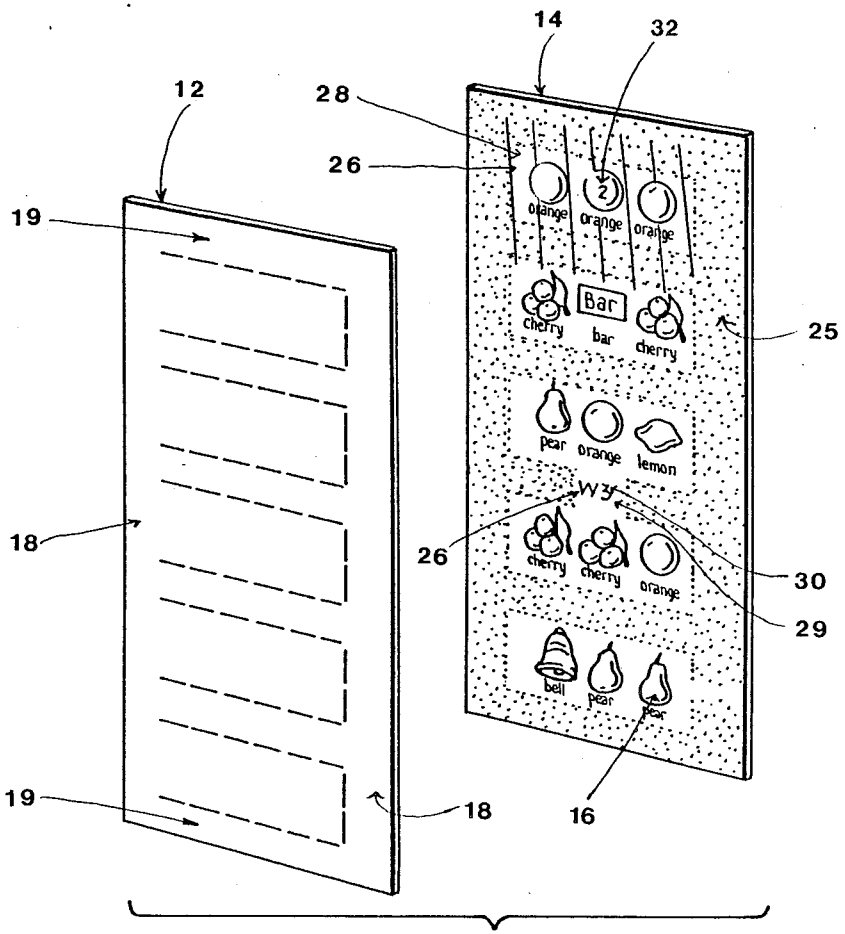
FIG. 2 is a perspective exploded view of the lottery ticket of FIG. 1.
Figure 1:
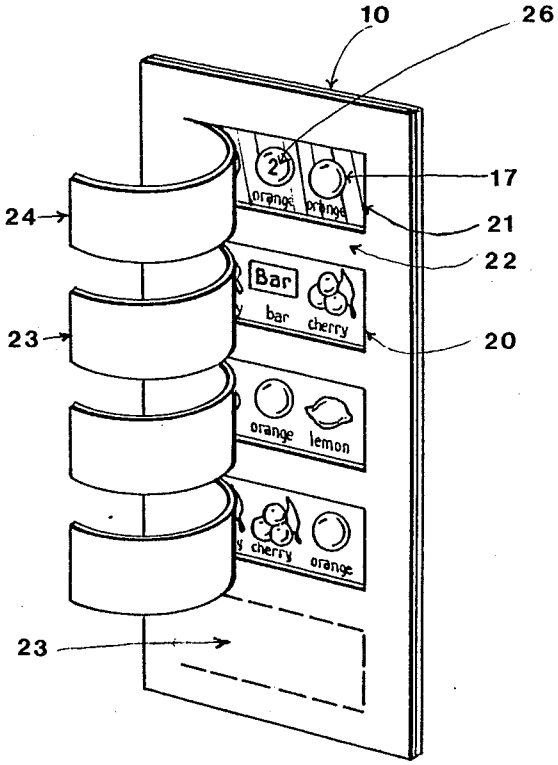
FIG. 1 is a perspective view of a lottery ticket.

In the drawings, a lottery ticket is generally denoted by the reference 10. The lottery ticket 10 comprises a front sheet 12 and a rear sheet 14. The front sheet 12 has two vertical side strips 18 and top and bottom strips 19 which define the periphery of the front sheet 12, each of the strips 18, 19 being of uniform width. Four bars 22 extend between the side strips 18, to define windows 20. The rear sheet bears fifteen symbols 16 arranged on the front face thereof. These symbols 16 are arranged in five sets containing three symbols each. The symbols 16 include one set of winning symbols 17. The windows 20 are positioned so that when the front sheet is bonded to the rear sheet, each set of the symbols 16 is located in a respective window 20. The window in which the winning symbols 17 are located is denoted by the reference 21.

Closure panels 23 are integrally formed as part of the front sheet 12. Each closure panel 23 is die cut from the front sheet 12 to form simultaneously a panel 23 and window 20. The panel 23 is separated by perforations along three sides from the surrounding parts of the front sheet 12. The left hand side of each panel 23 is continuous with one side strip 18, so as to be capable of being folded back as shown. In the embodiment shown, there are five panels 23 and windows 20, with the top four panels 23 being shown opened or folded back. The panel for the winning window 21 is denoted by the reference 24. In a conventional lottery ticket, the front sheet, except for the panels, is glued to the rear sheet.

Usually, a number of different symbols, commonly pictures of fruit, are used. A number of set combinations are determined to be winning combinations with corresponding prizes. Usually, each winning combination or set is a set of three identical symbols, with a prize awarded according to what the symbols are. It is also to be appreciated that, whilst this description relates to sets of three symbols, a different number of symbols could be used.

In accordance with the present invention, the lottery ticket 10 includes a number of different security features, to prevent fraudulent alterations to the ticket, or at least render them difficult to effect.

The front sheet 12 and the rear sheet 14 are bonded together by means of a pattern gluing process. The glue is placed on the portion of rear sheet 14 that does not contain any of the symbols 16 and which abuts the strips 18, 19 and bars 22 of the front sheet 12. This portion of rear sheet 14 is generally indicated by the stippled area in FIG. 2 which is indicated by number 25. To ensure the panels 23 are not accidentally glued to the rear sheet 14, the glue pattern 25 would be configured to be clear of the edges of the windows 20. Consequently, when the front sheet is placed on top, the panels 23 may be partially detached and bent back to open the windows 20, thereby revealing the symbols 16. While a pattern gluing process is used in the preferred embodiment, any particular bonding method may be used as long as the panels 23 are not bonded to the rear sheet 14.

The rear sheet 14 bears a number of different security indicia 26. The security indicia 26 include a pattern 28, a winning prize code 30 and a winning ticket code 32. The pattern 28 is printed on the portion of the rear sheet, which bears the winning symbols 17.

This pattern 28 extends to the part of the rear sheet 14 which is covered by that portion of the front sheet 12 surrounding the winning window 21. Thus, the pattern 28 extends beyond the window 21. It is preferred for the pattern 28 to extend fully under the two adjacent bars 22, or top or bottom strip 19 when appropriate. Further, the pattern 28 can extend into the edge of an adjacent window 20.

In this preferred embodiment, as shown, the pattern 28 is a series of parallel lines, which are inclined slightly to the vertical. The lines are printed in a distinctive colour under the winning symbols 18. A distinctive colour, e.g. yellow, can be used, and it can be selected from the colours used for the fruit symbols. It is also possible for the pattern 28 to be varied according to the winning symbols 17 present; and thus, the angle of the lines could be varied.

The purpose of the pattern 28 is to assist the organizers of a lottery, e.g. a charitable organization, in detecting fraudulent attempts at altering the lottery tickets 10. One of the prime fraudulent methods used in the past, as mentioned above, is the substitution of a set of winning symbols from one ticket into another. Thus, a person obtains a previously honoured winning ticket, carefully cuts out the set of winning symbols and glues them into another ticket. The pattern 28 prevents such a practice. On presentation of a winning ticket, the edges of the winning window 21 are peeled back, to check that the hidden part of the pattern 28 corresponds to that in the winning window 21. If the lines do not match up, then this is a clear indication that someone has tampered with the ticket. Appropriate disciplinery action can then be taken. Since the security pattern 28 extends across the glue pattern 25, it is extremely difficult, if not impossible, for someone to remove a complete set of winning symbols 17 and their security pattern 28, and then substitute these into an otherwise losing ticket. Such an action would require disruption of the glue pattern 25, and would almost certainly be detectible in the tampered ticket.

A further security indicia is the winning prize code 30. This winning prize code 30 is provided under one of the bars 22, as shown in FIG. 2. It is preferred to provide the winning prize code 30 under the third bar from the top.

To enable this winning prize code 30 to be examined, the glue pattern 25 includes a gap, indicated at 29. In conventional glue patterns, the glue extends all the way across for each bar. Consequently, in a problem presentation of an allegedly winning ticket, the lottery organizers can clip or remove the part of the bar 22 above the winning prize code 30, to reveal it.

The winning prize code 30 corresponds to the set of winning symbols 17, and to the prize that should be awarded. For example, in this preferred embodiment, all winning tickets which contain three "bars" bear the winning prize code "W1". Similarly tickets which contain three "bells", three "oranges", three "lemons" and three "cherries" have the winning prize codes "W2", "W3", "W4" and "W5" respectively. FIG. 2 shows a set of three oranges in the top window, and the corresponding winning prize code "W3". With losing tickets, the space in the glue pattern 25 is left blank and, the entire bar may be glued to rear sheet 14.

This provides an additional security check. If someone wishes to tamper with a losing ticket, they will not only have to form a set of winning symbols, but also provide an appropriate winning prize code 30. Upon presentation of a ticket, the organizers will rip the appropriate bar 22 to check the winning prize code 30. This provides additional security, as it prevents a winning ticket being presented a second time. It is extremely difficult to repair the broken bar 22, so that it appears that it has never been broken.

The winning ticket code 32 is located on the portion of rear sheet 14 in the winning window 21 which contains the winning symbols 17. The winning ticket code 32 is a numeral. In a series of tickets, each set of winning symbols will be present a predetermined number of times. For each particular prize which is denoted by a different winning symbol, there are a series of numbers each number indicating the number of the winning ticket. For example, if a series of winning tickets contained four tickets which each contained the winning symbols of three oranges, then each of those four winning ticket would contain one of the four numbers 1, 2, 3 or 4. By keeping track of the winning ticket code on each winning ticket for a particular set of winning symbols 17, the person running the lottery would be able to determine if a particular prize has been claimed more than once.

For certain sets of winning symbols 17, there are a large number of small prizes. For most purposes, it is impractical to monitor the exact number of each small prize, and accordingly a winning prize code 30 is not provided for these smaller prizes. Conventionally, the sets of "lemons" and "cherries" are small prizes. Also, the major problems of fraudulent tampering involve the larger prizes.

It will be appreciated that the above description is a preferred embodiment of the invention, and that many modifications are possible. In particular, the security indicia 26 may be used either in combination or singularly.

Also, as shown, each fruit symbol can be printed with its name underneath. For losing symbols 16 the name can be printed in one colour, e.g. black, and for winning symbols 17 it can be printed in another colour, e.g. red.

While the preferred embodiment utilizes sheets of paper, the subject matter of the present invention may be used on any ticket which has a window which may be removed to reveal a set of symbols. For example, the invention may be used in conjunction with a ticket where the material which covers the symbols is scratched off.

We claim:

1. A lottery ticket comprising: a front sheet which defines a plurality of windows and includes a plurality of bars separating said windows from one another and a plurality of closure panels closing the windows; a rear sheet; means bonding said front and rear sheets together; a plurality of symbols on one side of the rear sheet facing the front sheet, which symbols are arranged in sets of symbols including a set of winning symbols with each set of symbols located within a respective window and the set of winning symbols located in a winning window; and security indicia comprising a winning ticket code, indicative of the position of the winning ticket in a series of winning tickets having a corresponding set of winning symbols.

2. A lottery ticket comprising: a front sheet which defines a plurality of windows and includes a plurality of bars separating said windows from one another and a plurality of closure panels closing the windows; a rear sheet; means bonding said front and rear sheets together; a plurality of symbols on one side of said rear sheet facing said front sheet which symbols are arranged in sets of symbols including a set of winning symbols with each set of symbols located within a respective window and the set of winning symbols located within a winning window; and security indicia comprising a pattern and a winning ticket code on said one side of the rear sheet within the winning window.

3. A lottery ticket comprising: a front sheet which defines a plurality of windows and includes a plurality of bars separating said windows from one another and a plurality of closure panels closing the windows; a rear sheet; means bonding the front and rear sheets together; a plurality of symbols on one side of the rear sheet facing the front sheet, which symbols are arranged in sets of symbols including a set of winning symbols with each set of symbols located within a respective window and said set of winning symbols located in a winning window; and security indicia, comprising a winning prize code on said one side of said rear sheet, concealed by the front sheet.

4. A lottery ticket comprising a rectangular front sheet which defines five windows and includes four bars separating said windows from one another, said windows being located in a stacked formation, a rectangular rear sheet, means bonding said front and rear sheets together, a plurality of symbols on one side of said rear sheet facing said front sheet, said symbols being arranged into sets of symbols including a set of winning symbols with each set of symbols located within a respective window and said set of winning symbols being located in a winning window, and security indicia on said one side of the rear sheet, the security indicia being selected from the group comprising: a pattern within the winning window and extending beyond the window under the front sheet; a winning ticket code within the winning window indicating the position of the ticket in a series of winning tickets bearing corresponding sets of winning symbols; and a winning prize code concealed by the front sheet.

5. A lottery ticket comprising: a front sheet which defines a plurality of windows and includes a plurality of bars separating said windows from one another and a plurality of closure panels closing the windows; a rear sheet; means bonding said front and rear sheets together; a plurality of symbols on one side of the rear sheet facing the front sheet, which symbols are arranged in sets of symbols including a set of winning symbols with each set of symbols located within a respective window and the set of winning symbols located in a winning window; and security indicia comprising a pattern and a winning prize code on said one side of the rear sheet, with the pattern being located within the winning window and the winning prize code being concealed by the front sheet.

6. A lottery ticket as claimed in claim 2 wherein the security indicia further comprises a winning prize code on said one side of the rear sheet, concealed by the front sheet.

7. A lottery ticket as claimed in claim 1, wherein said security indicia includes a winning prize code on one side of said rear sheet concealed by the front sheet.

8. A lottery ticket as claimed in claim 6 wherein said winning ticket code is a numeral indicating the number of the winning ticket in said series of winning tickets, said numeral being located in said set of winning symbols.

9. A lottery ticket as claimed in claim 7, 3, 6 or 5 wherein said winning prize code is located under one of said bars.

10. A lottery ticket as claimed in claim 9 wherein said bonding means comprises a glue pattern between the front and rear sheets which, with the exception of the closure panels, bonds the front and rear sheets together, and which does not overlap the winning prize code and only bonds sides of said bar under which said winning prize code is located to said rear sheet.

11. A set of lottery tickets as claimed in claim 4, wherein for each winning ticket the security indicia includes said winning ticket code and the winning ticket codes of all the tickets form a continuous series.

12. A lottery ticket as claimed in claim 6, wherein the pattern is located under the winning symbols, and the winning ticket code is located in one of said winning symbols.

13. A lottery ticket as claimed in claim 5, wherein the pattern is located under the winning symbols.

14. A lottery ticket as claimed in claim 12 or 13, wherein the winning prize code is located under one of the bars of the front sheet, and wherein said bonding means comprises a glue pattern between the front and rear sheets which, with the exception of the closure panels, bonds the front and rear sheets together, and which does not overlap the winning prize code and only bonds sides of said bar under which said winning prize code is located to said rear sheet.

15. A lottery ticket as claimed in claim 2, wherein the pattern is located under the winning symbols, and the winning ticket code is located in one of said winning symbols.

16. A lottery ticket as claimed in claim 12, 15 or 13, wherein the pattern extends across the winning window and under portions of the front sheet surrounding the winning window.

17. A lottery ticket as claimed in claim 16, wherein said bonding means comprises a glue pattern between the front and rear sheets which, with the exception of the closure panels, bonds the front and rear sheets together.

* * * * *